United States Patent [19]

Hanchett, Jr. et al.

[11] Patent Number: 4,626,010

[45] Date of Patent: Dec. 2, 1986

[54] CONCEALED DOOR RELEASE MECHANISM

[75] Inventors: Leland J. Hanchett, Jr., Phoenix; Mark A. Lawrence, Mesa, both of Ariz.

[73] Assignee: Hanchett Entry Systems, Inc., Phoenix, Ariz.

[21] Appl. No.: 823,825

[22] Filed: Jan. 28, 1986

Related U.S. Application Data

[63] Continuation of Ser. No. 578,886, Feb. 10, 1984, abandoned.

[51] Int. Cl.[4] ..... E05B 15/02

[52] U.S. Cl. ..... 292/341.16; 292/92; 292/341.17

[58] Field of Search ..... 292/341.15–341.17, 292/340.92

[56] References Cited

U.S. PATENT DOCUMENTS

| | | | |
|---|---|---|---|
| 508,518 | 11/1893 | Johnson | 292/341.16 |
| 3,211,850 | 10/1965 | Toepfer | 200/61.64 |
| 3,638,984 | 2/1972 | Davidson | 292/341.16 |
| 3,749,435 | 7/1973 | Balzano | 292/341.16 |
| 3,861,727 | 1/1975 | Froerup et al. | 292/341.16 |
| 3,910,617 | 10/1975 | Scalza et al. | 292/341.16 |
| 4,017,107 | 4/1977 | Hanchett | 292/341.16 |
| 4,026,589 | 5/1977 | Hanchett, Jr. | 292/341.16 |
| 4,083,590 | 4/1978 | Folger | 292/92 |
| 4,181,338 | 1/1980 | Sterling | 292/341.17 |

FOREIGN PATENT DOCUMENTS 2111113 6/1983 United Kingdom .

*Primary Examiner*—Robert L. Wolfe
*Assistant Examiner*—Russell W. Illich
*Attorney, Agent, or Firm*—Richards, Harris, Medlock & Andrews

[57] ABSTRACT

A door release mechanism (10) for a door (24) having a latch bolt (22) is provided. The door release mechanism (10) includes a strike block (12) adapted to receive the latch bolt (22). A ramped surface (26) is provided within the strike block (12) for urging the latch bolt (22) into the door (24) to thereby open the door (24). Structure (30, 42, 48) is further provided within strike block (12) for preventing the latch bolt (22) from being withdrawn within the door (24) for maintaining the door (24) closed.

6 Claims, 3 Drawing Figures

CONCEALED DOOR RELEASE MECHANISM

This application is a continuation of application Ser. No. 578,886, filed Feb. 10, 1984, now abandoned.

TECHNICAL FIELD

This invention relates to security devices, and more particularly to a concealed door release mechanism for doors utilizing latch bolts.

BACKGROUND ART

In security devices it is desirable to automatically release locks having latch bolts or guarded latch bolts. Such bolts are carried by a door and are received in a strike which is closed by a jamb. Previously developed automatically released devices have required modification of the lip of the jamb in which the release mechanism was mounted. In addition, such prior devices were vulnerable to attack at the point where the release mechanism was exposed outside the door jamb.

A need has thus arisen for a release mechanism that is completely concealed within the door jamb. A need has further arisen for a release mechanism that will release the latch bolt even in the presence of strong forces against the door. Such forces against the door can be caused by thick weather stripping, by air pressure differential from an air conditioning system, or by a person applying force to the door during actuation of the release mechanism.

DISCLOSURE OF THE INVENTION

In accordance with the present invention, a door release mechanism is provided which is concealed within a door jamb.

In accordance with the present invention, a door release mechanism for a door having a latch bolt is provided. A strike block is adapted to receive the latch bolt. Structure is provided within the strike block for urging the latch bolt into the door as the door is opened. Structure is further provided within the strike block for inhibiting opening of the door by preventing the latch bolt from engaging the structure for urging the latch bolt into the door.

In accordance with another aspect of the present invention, a door release mechanism for a door having a latch bolt is provided. A strike block is adapted to receive the latch bolt and includes a ramped surface over which the latch bolt travels. The ramp surface urges the latch bolt into the door to allow the door to open. A pivoting keeper is disposed within the strike block for selectively inhibiting allowing the latch bolt to travel over the ramped surface to prevent or allow the opening of the door. Structure is provided for controlling the position of the pivoting keeper with respect to the ramped surface of the strike block.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION

Figure 1:
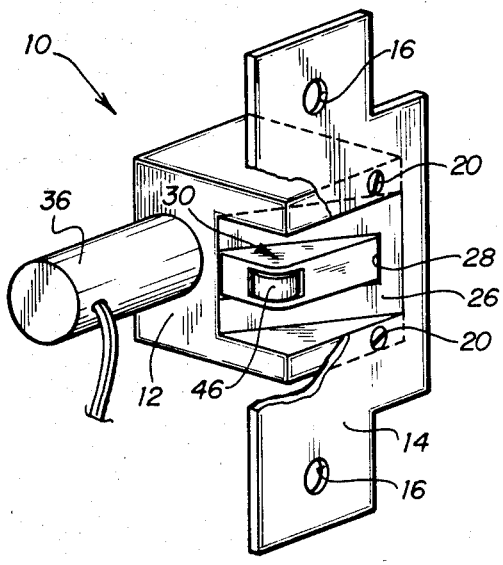
FIG. 1 is a perspective view of the present door release mechanism.
Figure 2:
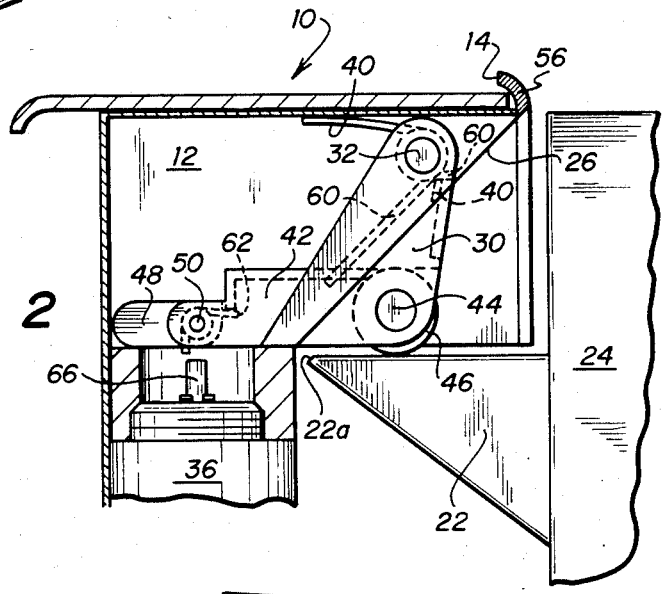
FIG. 2 is a side elevational view of the door release mechanism shown in FIG. 1 in the closed and locked position.

Referring simultaneously to FIGS. 1 and 2, the present door release mechanism is illustrated and is generally identified by the numeral 10. Door release mechanism 10 is mounted within a strike block 12 which is covered by a strike plate 14. Strike plate 14 includes apertures 16 for mounting strike plate 14 and strike block 12 to a door jamb (not shown). Strike block 12 is mounted to strike plate 14 utilizing screws 20.

Strike block 12 receives a latch bolt 22 carried by a door 24 when door 24 is in the closed position. Latch bolt 22 is retracted within door 24 as door 24 is opened. Latch bolt 22 is spring loaded and is extended into strike block 12 when door 24 is closed.

Disposed within strike block 12 is a ramped surface 26 over which latch bolt 22 travels. Also included within strike block 12 and disposed within a slot 28 within ramped surface 26 is a keeper mechanism 30. Keeper mechanism 30 is pivotable about pin 32 within strike block 12. As illustrated in FIG. 2, keeper mechanism 30 is in the closed position such that latch bolt 22 is positioned below keeper mechanism 30 at the bottom end of ramped surface 26.

Interconnected to strike block 12 is a solenoid 36 which when actuated causes keeper mechanism 30 to be retracted within strike block 12 as latch bolt 22 moves across ramped surface 26 from the bottom end of ramped surface 26 to the top end thereof. Such movement thereby enables door 24 to open. In the open position of door 24, keeper mechanism 30 automatically returns to the position illustrated in FIG. 2.

Referring more specifically to FIG. 2, associated with pin 32 is a return spring 40 which maintains keeper mechanism 30 in the position as illustrated in FIG. 2. Interconnected to keeper mechanism 30 is a channel-like dogging member 42 which is pivotally interconnected to keeper mechanism 30 via a pin 44. Also mounted on pin 44 is a roller 46. Pivotally interconnected to dogging member 42 is a lever member 48 via a pin 50. When solenoid 36 is energized, members 42 and 48 pivot to allow keeper mechanism 30 to pivot in a clockwise direction about pin 32. As latch bolt 22 moves up ramped surface 26, it is simultaneously forced into door 24 thus releasing door 24 near the end of travel of latch bolt 22. A short continuation of ramped surface 26 is provided by a bevel 56 on the opening in strike plate 14. A slight bevel **22*a* may be provided on latch bolt 22 to provide a smoother operation of latch bolt 22 as it travels over ramped surface 26**.

Figure 3:
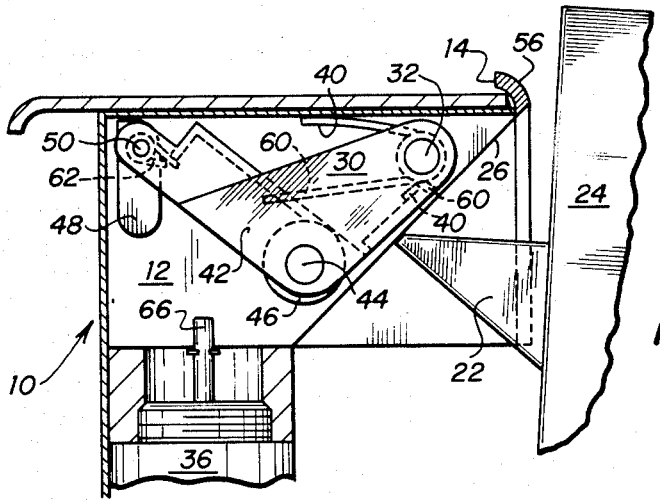
FIG. 3 is a side elevational view of the door release mechanism shown in FIG. 1 in the open and unlocked position.

Referring simultaneously to FIGS. 2 and 3, FIG. 2 illustrates keeper mechanism 30 in the closed position while FIG. 3 illustrates keeper mechanism 30 in the closed position. In the open position of keeper mechanism 30, keeper mechanism 30 is biased to its full counterclockwise position around pin 32 with members 42 and 48 horizontally disposed. Return spring 40 biases keeper mechanism 30 to the closed position as illustrated in FIG. 2.

A bias spring 60 also extends around pin 32 and engages dogging member 42. Bias spring 60 maintains dogging member 42 in its fully counterclockwise position about pin 44. A torsion spring 62 is mounted around pin 50 to hold lever member 48 in its fully clockwise position about pin 50. Torsion spring 62 may be held within a groove in lever member 48. Springs 40, 60 and 62, bias keeper mechanism 30, dogging member 42 and lever member 48 in the position shown in FIG. 2.

A push plunger 66 extends from solenoid 36 into strike block 12 when solenoid 36 is electrically energized. When solenoid 36 is energized, push plunger 66 engages pin 50 interconnecting dogging member 42 and lever member 48 to allow keeper mechanism 30 to move to a slightly less than perpendicular position within strike block 12. Latch bolt 22 is then free to move up ramped surface 26 and into a fully released condition as illustrated in FIG. 3. Roller 46 mounted to pin 44 provides for a smoother operation of keeper mechanism 30 as latch bolt 22 retracts keeper mechanism 30 into strike block 12 out of the path of ramped surface 26 to allow latch bolt 22 to completely retract within door 24.

Once latch bolt 22 has cleared keeper mechanism 30, keeper mechanism 30 will automatically return to the closed and locked position due to springs 40, 60 and 62 as illustrated in FIG. 2, but without the presence of door 24 and latch bolt 22. When door 24 is again closed, strike plate 14 forces latch bolt 22 back into door 24. Latch bolt 22 stays within door 24 until latch bolt 22 has cleared keeper mechanism 30 at which time latch bolt 22, due to the spring loading forces on latch bolt 22, reenters strike block 12 below dogging member 42 as illustrated in FIG. 2.

A fail-safe operation of the present door release mechanism 10 can be accomplished by changing the operation of solenoid 36 from a push solenoid to a spring loaded pull solenoid. In the unpowered condition, push plunger 66 is spring loaded to pin 50. When power is applied, push plunger 66 moves out of the way and dogging member 42 and lever member 48 are locked.

It therefore can be seen that the present invention provides for a door release mechanism that is substantially concealed and not visible when the door is closed. The present release mechanism is automatically actuated through operation of a solenoid thereby rendering the present release mechanism invulnerable to attack.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A door release mechanism for a door having a latch bolt, comprising:

a strike block adapted to receive the latch bolt and having a ramped surface over which the latch bolt travels;

said ramped surface having first and second ends and top and bottom sides, such that the latch bolt travels over said top side;

the latch bolt extending into said strike block a maximum distance to said top side of said ramped surface at said first end thereof and extending into said strike block a minimum distance to said top side of said ramped surface at said second end thereof;

said ramped surface adapted for urging the latch bolt into the door, thereby allowing the opening of the door;

said ramped surface having a slotted aperture;

a keeper pivotally mounted within said strike block adjacent said bottom side and said second end of said ramped surface and extending through said aperture;

a dogging member pivotally attached to said keeper within said strike block adjacent said bottom side and said first end of said ramped surface and adapted to engage the latch bolt to maintain the door in a closed position by preventing the latch bolt from traveling over said ramped surface;

a lever member pivotally attached to the end of said dogging member distal said keeper; and means attached to said strike block proximate said lever member for actuating said lever member, thereby allowing said dogging member and said keeper to pivot within said strike block and to withdraw from said aperture to permit the latch bolt to travel over said ramped surface from said first end to said second end thereof.

2. The door release mechanism of claim 1, further comprising means for biasing said keeper and said dogging member within said slotted aperture.

3. The door release of claim 2, further comprising means for biasing said lever member in alignment with said dogging member.

4. The door release mechanism of claim 1, wherein said means for actuating said lever member includes an electromagnetic solenoid.

5. A concealed door release mechanism for a door having a retractable latch bolt, comprising:

a strike block adapted to receive the latch bolt and having a ramped surface over which the latch bolt travels;

said ramped surface having first and second ends and top and bottom sides, such that the latch bolt travels over said top side;

the latch bolt extending into said strike block a maximum distance to said top side of said ramped surface at said first end thereof and extending into said strike block a minimum distance to said top side of said ramped surface at said second end thereof;

said ramped surface adapted for urging the retractable latch bolt into the door, thereby allowing the opening of the door;

said ramped surface having a slotted aperture;

a keeper pivotally mounted within said strike block adjacent said bottom side and said second end of said ramped surface and extending through said aperture;

a dogging member pivotally attached to said keeper within said strike block adjacent said bottom side and said first end of said ramped surface and adapted to engage the latch bolt to maintain the door in a closed position by preventing the latch bolt from traveling over said ramped surface;

means for biasing said keeper and said dogging member within said slotted aperture;

a lever member pivotally attached to the end of said dogging member distal said keeper; and means including an electromagnetic solenoid attached to said strike block proximate said lever member for actuating said lever member, thereby allowing said dogging member and said keeper to pivot within said strike block and to withdraw from said aperture to permit the latch bolt to travel over said ramped surface from said first end to said second end thereof.

6. The concealed door release mechanism of claim 5, further comprising means for biasing said lever member in alignment with said dogging member.

* * * * *